US008769938B2

(12) United States Patent
Wagner et al.

(10) Patent No.: US 8,769,938 B2
(45) Date of Patent: Jul. 8, 2014

(54) EXHAUST TREATMENT DEVICE WITH ELECTRIC REGENERATION SYSTEM

(75) Inventors: Wayne M. Wagner, Apple Valley, MN (US); John T. Herman, Rhinelander, WI (US); Mary J. Lorenzen, Chanhassen, MN (US); Wenzhong Zhang, Savage, MN (US)

(73) Assignee: Donaldson Company, Inc., Minneapolis, MN (US)

( * ) Notice: Subject to any disclaimer, the term of this patent is extended or adjusted under 35 U.S.C. 154(b) by 20 days.

(21) Appl. No.: 13/401,417

(22) Filed: Feb. 21, 2012

(65) Prior Publication Data

US 2012/0291895 A1 Nov. 22, 2012

Related U.S. Application Data

(63) Continuation of application No. 11/753,986, filed on May 25, 2007, now Pat. No. 8,117,832.

(60) Provisional application No. 60/814,952, filed on Jun. 19, 2006.

(51) Int. Cl.

| | |
|---|---|
| ***F01N 3/00*** | (2006.01) |
| ***F01N 3/02*** | (2006.01) |
| ***B01D 39/00*** | (2006.01) |
| ***B01D 41/00*** | (2006.01) |
| ***B01D 45/00*** | (2006.01) |
| ***B01D 46/00*** | (2006.01) |
| ***B01D 49/00*** | (2006.01) |
| ***B01D 50/00*** | (2006.01) |
| ***B01D 51/00*** | (2006.01) |

(52) U.S. Cl.
USPC ..... 60/295; 60/311; 55/282.3

(58) Field of Classification Search
USPC ..... 60/295, 311; 55/282.3, DIG. 10, DIG. 30
See application file for complete search history.

(56) References Cited

U.S. PATENT DOCUMENTS

| | | | |
|---|---|---|---|
| 3,499,260 | A | 3/1970 | Forman |
| 4,167,852 | A | 9/1979 | Ludecke |
| 4,211,075 | A | 7/1980 | Ludecke et al. |
| 4,270,936 | A | 6/1981 | Mann |
| 4,276,066 | A | 6/1981 | Bly et al. |
| 4,319,896 | A | 3/1982 | Sweeney |
| 4,395,269 | A | 7/1983 | Schuler |

(Continued)

FOREIGN PATENT DOCUMENTS

| | | | | |
|---|---|---|---|---|
| GB | 2134407 | | 8/1984 | |
| JP | 2002097931 | A * | 4/2002 | ..... F01N 3/02 |

(Continued)

OTHER PUBLICATIONS

Cleaire Products Catalog, Horizon™, May 10, 2006, 7 Pages.

(Continued)

*Primary Examiner* — Audrey K Bradley
(74) *Attorney, Agent, or Firm* — Merchant & Gould P.C.

(57) ABSTRACT

The present disclosure relates to a diesel exhaust treatment device including a catalytic converter positioned upstream from a diesel particulate filter. An electric heater is positioned between the catalytic converter and the diesel particulate filter. A shore station can be used to provide power and combustion air to the diesel exhaust treatment device during regeneration of the diesel particulate filter.

25 Claims, 17 Drawing Sheets

(56) References Cited

U.S. PATENT DOCUMENTS

| | | | |
|---|---|---|---|
| 4,452,616 | A | 6/1984 | Gillingham et al. |
| 4,456,457 | A | 6/1984 | Nozawa et al. |
| 4,504,293 | A | 3/1985 | Gillingham et al. |
| 4,505,106 | A | 3/1985 | Frankenberg et al. |
| 4,573,317 | A | 3/1986 | Ludecke |
| 4,686,827 | A | 8/1987 | Wade et al. |
| 4,735,639 | A | 4/1988 | Johnstone |
| 4,851,015 | A | 7/1989 | Wagner et al. |
| 4,867,768 | A | 9/1989 | Wagner et al. |
| 4,878,928 | A | 11/1989 | Wagner et al. |
| 4,899,540 | A | 2/1990 | Wagner et al. |
| 4,902,309 | A | 2/1990 | Hempenstall |
| 4,902,487 | A | 2/1990 | Cooper et al. |
| 5,042,249 | A | 8/1991 | Erdmannsdoerfer |
| 5,053,603 | A | 10/1991 | Wagner et al. |
| 5,065,574 | A | 11/1991 | Bailey |
| 5,101,095 | A | 3/1992 | Wagner et al. |
| 5,203,166 | A | 4/1993 | Miller |
| 5,224,973 | A | 7/1993 | Hoppenstedt et al. |
| 5,355,973 | A | 10/1994 | Wagner et al. |
| 5,388,400 | A | 2/1995 | Hoppenstedt et al. |
| 5,397,550 | A | 3/1995 | Marino, Jr. |
| 5,400,590 | A | 3/1995 | Wagner et al. |
| 5,435,129 | A | 7/1995 | Hosoya et al. |
| 5,458,673 | A | 10/1995 | Kojima et al. |
| 5,551,971 | A | 9/1996 | Chadderton et al. |
| 5,833,725 | A | 11/1998 | Dehn et al. |
| 5,930,994 | A | 8/1999 | Shimato et al. |
| 6,090,172 | A | 7/2000 | Dementhon et al. |
| 6,233,926 | B1 | 5/2001 | Bailey et al. |
| 6,641,646 | B2 | 11/2003 | Rosenberg |
| 6,922,891 | B1 | 8/2005 | Marino, Jr. |
| 7,357,829 | B2 | 4/2008 | Ehlers |
| 7,384,455 | B2 | 6/2008 | Sellers et al. |
| 7,410,521 | B2 | 8/2008 | Sellers et al. |
| 7,410,529 | B2 | 8/2008 | Sellers et al. |
| 7,419,532 | B2 | 9/2008 | Sellers et al. |
| 7,421,839 | B2 | 9/2008 | Igarashi |
| 7,458,207 | B2 | 12/2008 | Ehlers |
| 7,462,222 | B2 | 12/2008 | Sellers et al. |
| 7,563,309 | B2 | 7/2009 | Simpson, Jr. |
| 7,582,141 | B2 | 9/2009 | Ehlers |
| 7,648,792 | B2 | 1/2010 | Kaschmitter et al. |
| 7,716,922 | B2 | 5/2010 | Ehlers |
| 7,951,346 | B2 | 5/2011 | Girdlestone et al. |
| 8,117,832 | B2 | 2/2012 | Wagner et al. |
| 8,142,552 | B2 | 3/2012 | Meister et al. |
| 8,157,897 | B2 | 4/2012 | Meister et al. |
| 8,172,339 | B2 | 5/2012 | Fries et al. |
| 8,256,060 | B2 | 9/2012 | Wagner et al. |
| 2004/0226287 | A1 | 11/2004 | Edgar et al. |
| 2005/0153828 | A1 | 7/2005 | Uekusa et al. |
| 2005/0160724 | A1 | 7/2005 | Valentine et al. |
| 2005/0247051 | A1 | 11/2005 | Wagner et al. |
| 2006/0070360 | A1 | 4/2006 | Sellers et al. |
| 2006/0120936 | A1 | 6/2006 | Alive et al. |
| 2006/0137329 | A1 | 6/2006 | Lowe et al. |
| 2006/0168952 | A1 | 8/2006 | Opris |
| 2006/0191412 | A1 | 8/2006 | Sellers et al. |
| 2009/0044523 | A1 | 2/2009 | Wagner et al. |

FOREIGN PATENT DOCUMENTS

| | | | |
|---|---|---|---|
| JP | 2003027922 | | 1/2003 |
| JP | 2004/239072 | A | 8/2004 |
| WO | WO 93/03262 | A1 | 2/1993 |
| WO | WO 95/23280 | A1 | 8/1995 |
| WO | WO 2005/028824 | A1 | 3/2005 |
| WO | WO 2006/096244 | A1 | 9/2006 |

OTHER PUBLICATIONS

Engine Control Systems, "CombiClean™—the diesel particulate filter cleaning station for all your filter cleaning needs," Jan. 2006, 3 Pages.

Kilcarr, Sean, "Truck Engine Emissions Update: The Road to '07", Dec. 1, 2004, archived Feb. 15, 2005, Waste Age, pp. 1-4.

Kojima, English Abstract of JP 2003-027922 A, Jan. 29, 2003.

Kojima, Machine Translation of JP 2003-027922 A, Jan. 29, 2003.

* cited by examiner

EXHAUST TREATMENT DEVICE WITH ELECTRIC REGENERATION SYSTEM

CROSS-REFERENCE TO RELATED APPLICATIONS

This application is a continuation of application Ser. No. 11/753,986, filed May 25, 2007, now U.S. Pat. No. 8,117,832, Issued Feb. 21, 2012, which application claims the benefit of provisional application Ser. No. 60/814,952, filed Jun. 19, 2006, which applications are incorporated herein by reference in their entirety.

TECHNICAL FIELD

The present invention relates generally to engine exhaust treatment systems. More particularly, the present disclosure relates to engine exhaust treatment systems including diesel particulate filters and heaters for regenerating the diesel particulate filters.

BACKGROUND

Vehicles equipped with diesel engines may include exhaust systems that have diesel particulate filters for removing particulate matter from the exhaust stream. With use, soot or other carbon-based particulate matter accumulates on the diesel particulate filters. As particulate matter accumulates on the diesel particulate filters, the restriction of the filters increases causing the buildup of undesirable back pressure in the exhaust systems. High back pressures decrease engine efficiency. Therefore, to prevent diesel particulate filters from becoming excessively loaded, diesel particulate filters should be regularly regenerated by burning off (i.e., oxidizing) the particulates that accumulate on the filters. Since the particulate matter captured by diesel particulate filters is mainly carbon and hydrocarbons, its chemical energy is high. Once ignited, the particulate matter burns and releases a relatively large amount of heat.

Systems have been proposed for regenerating diesel particulate filters. Some systems use a fuel fed burner positioned upstream of a diesel particulate filter to cause regeneration (see U.S. Pat. No. 4,167,852). Other systems use an electric heater to regenerate a diesel particulate filter (see U.S. Pat. Nos. 4,270,936; 4,276,066; 4,319,896; 4,851,015; 4,899,540; 5,388,400 and British Published Application No. 2,134,407). Detuning techniques are also used to regenerate diesel particulate filters by raising the temperature of exhaust gas at selected times (see U.S. Pat. Nos. 4,211,075 and 3,499,260). Self regeneration systems have also been proposed. Self regeneration systems can use a catalyst on the substrate of the diesel particulate filter to lower the ignition temperature of the particulate matter captured on the filter. An example of a self regeneration system is disclosed in U.S. Pat. No. 4,902,487.

SUMMARY

One aspect of the present disclosure relates to an exhaust treatment device including a diesel particulate filter (DPF), a diesel oxidation catalyst (DOC) (i.e., a catalytic converter) and an electric heater for regenerating the DPF. In certain embodiments, the heater is positioned between the DPF and the DOC.

Another aspect of the disclosure relates to a shore station for providing power and combustion air to an exhaust treatment device equipped with an electric heater.

Examples representative of a variety of inventive aspects are set forth in the description that follows. The inventive aspects relate to individual features as well as combinations of features. It is to be understood that both the forgoing general description and the following detailed description merely provide examples of how the inventive aspects may be put into practice, and are not intended to limit the broad spirit and scope of the inventive aspects.

Figure 1:
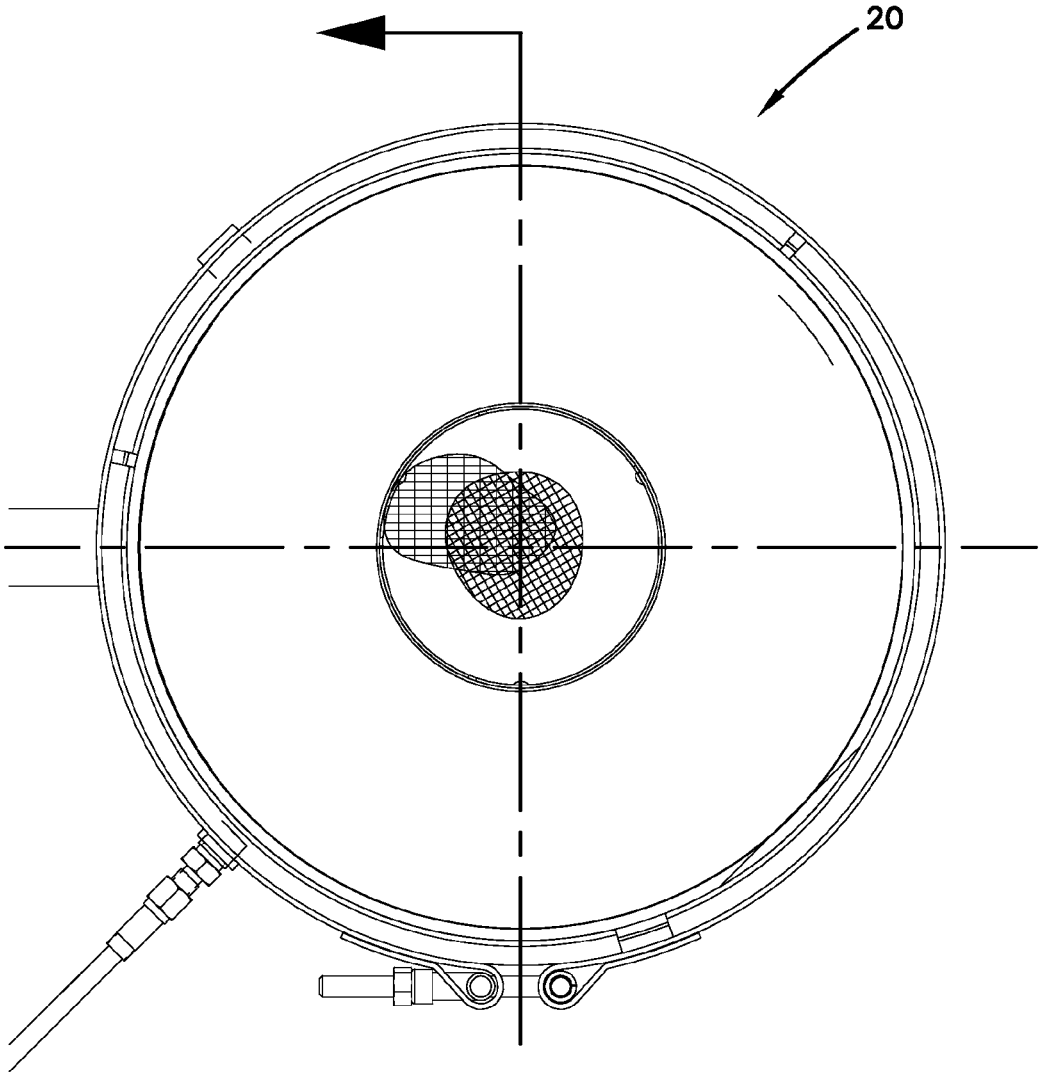
FIG. 1 is an end view an exhaust treatment device having features that are examples of inventive aspects in accordance with the principles of the present disclosure.

While the invention is amenable to various modifications and alternative forms, specifics thereof have been shown by way of example in the drawings and will be described in detail below. It is to be understood, however, that the intention is not to limit the invention to the particular embodiments described. On the contrary, the invention is intended to cover all modifications, equivalents, and alternatives falling within the scope of the disclosure.

DETAILED DESCRIPTION

Figure 2:
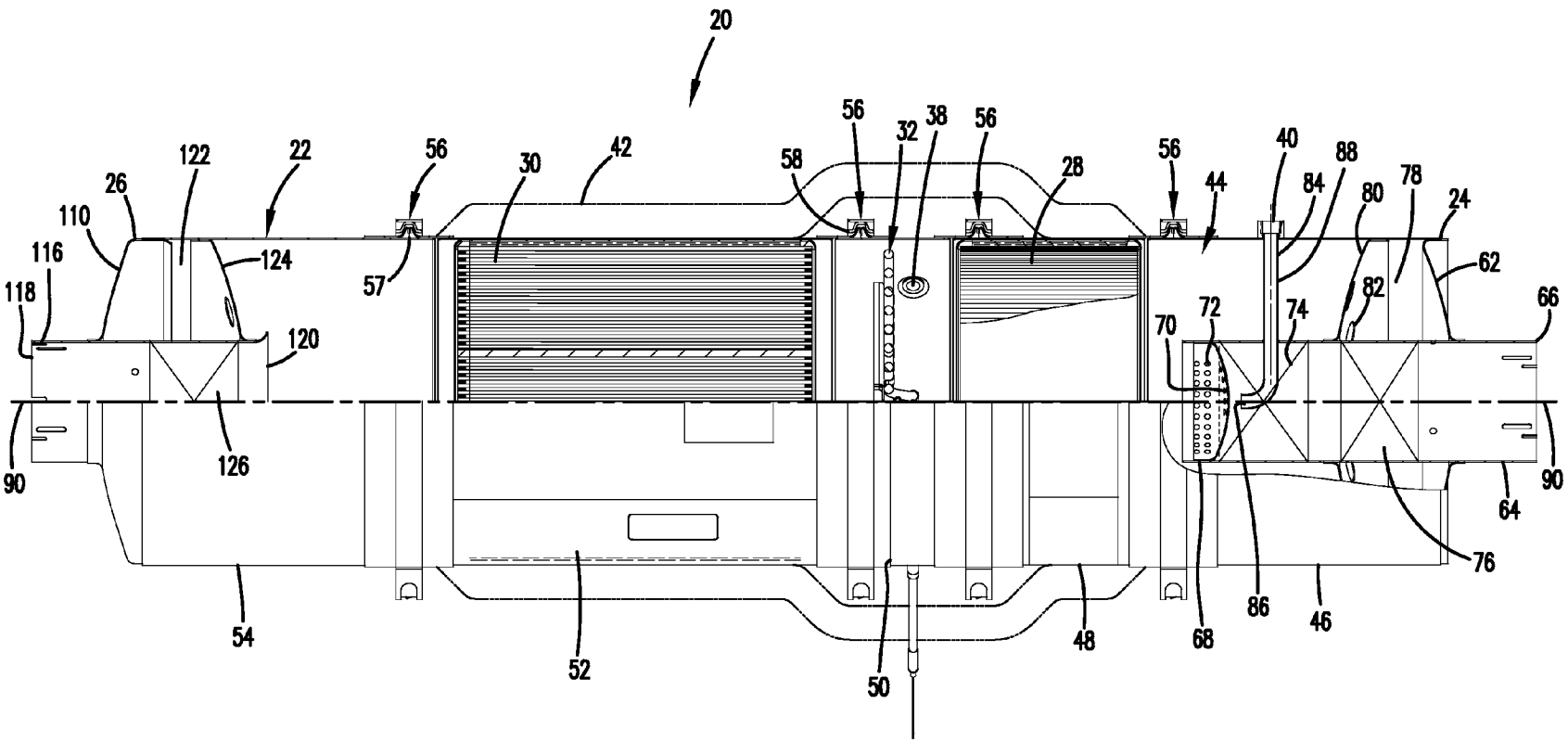
FIG. 2 is a cross-sectional view taken along section line 2-2 of FIG. 1.
Figure 8:
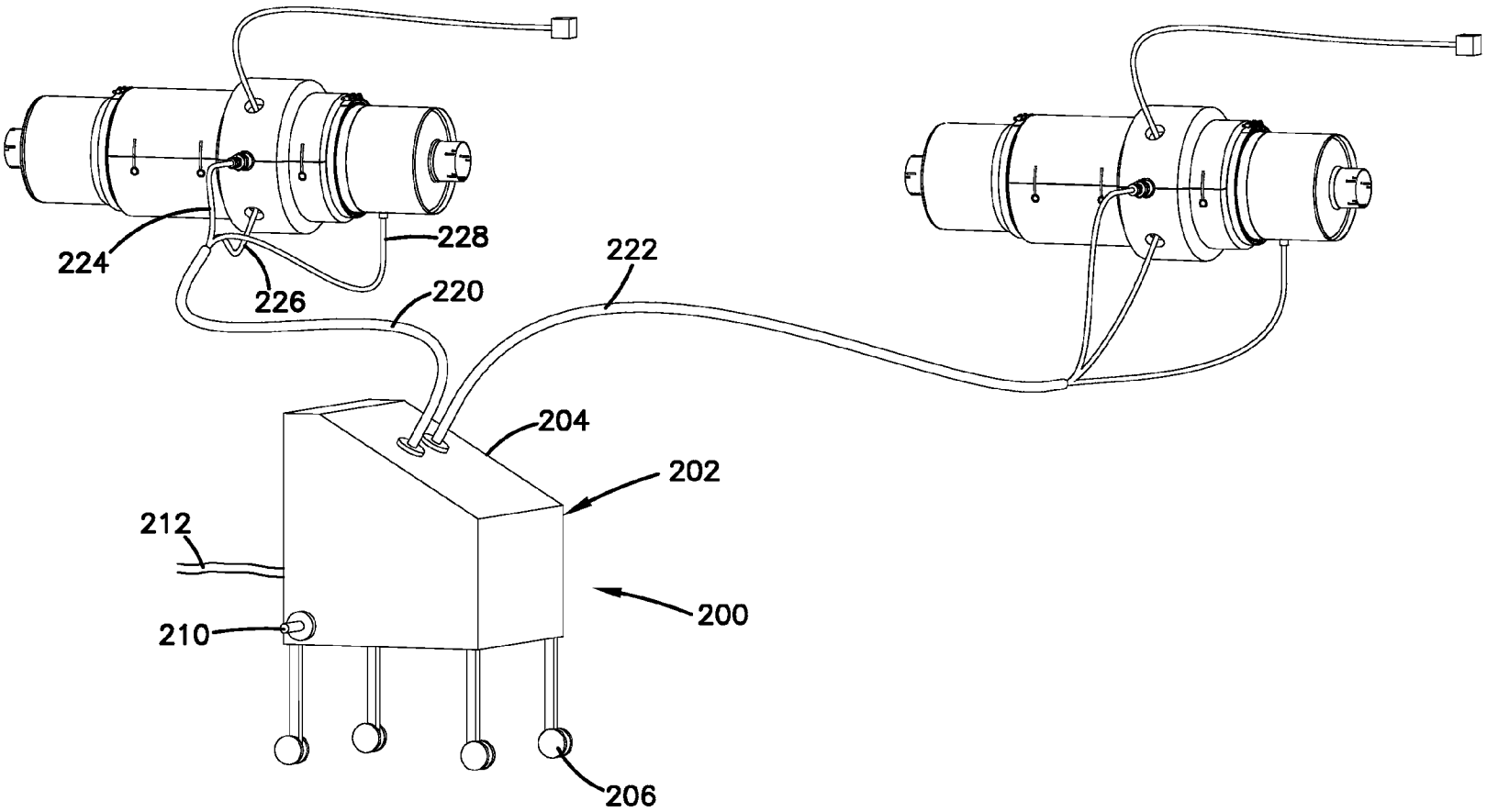
FIG. 8 is a perspective view of a shore station used to control regeneration of exhaust treatment devices such as the exhaust treatment device shown in FIGS. 1 and 2.
Figure 9:
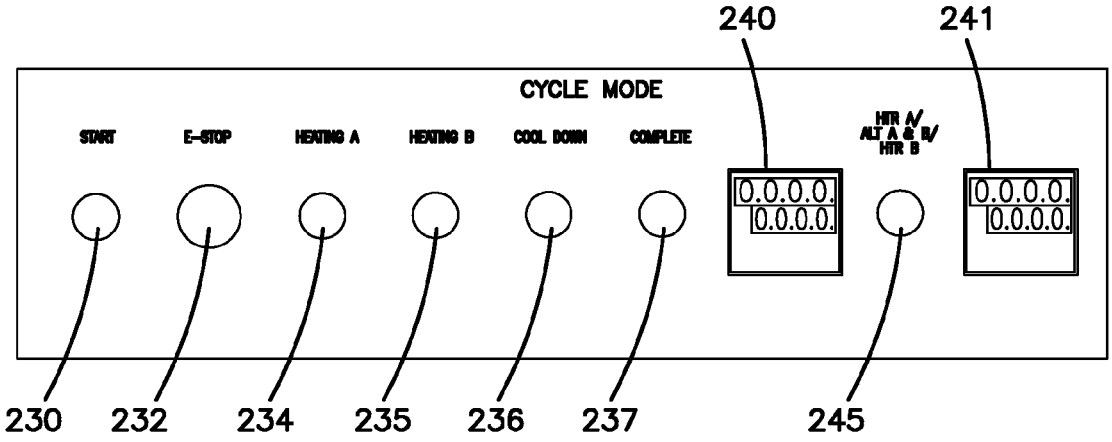
FIG. 9 shows a control panel of the shore station of FIG. 8.
Figure 10:
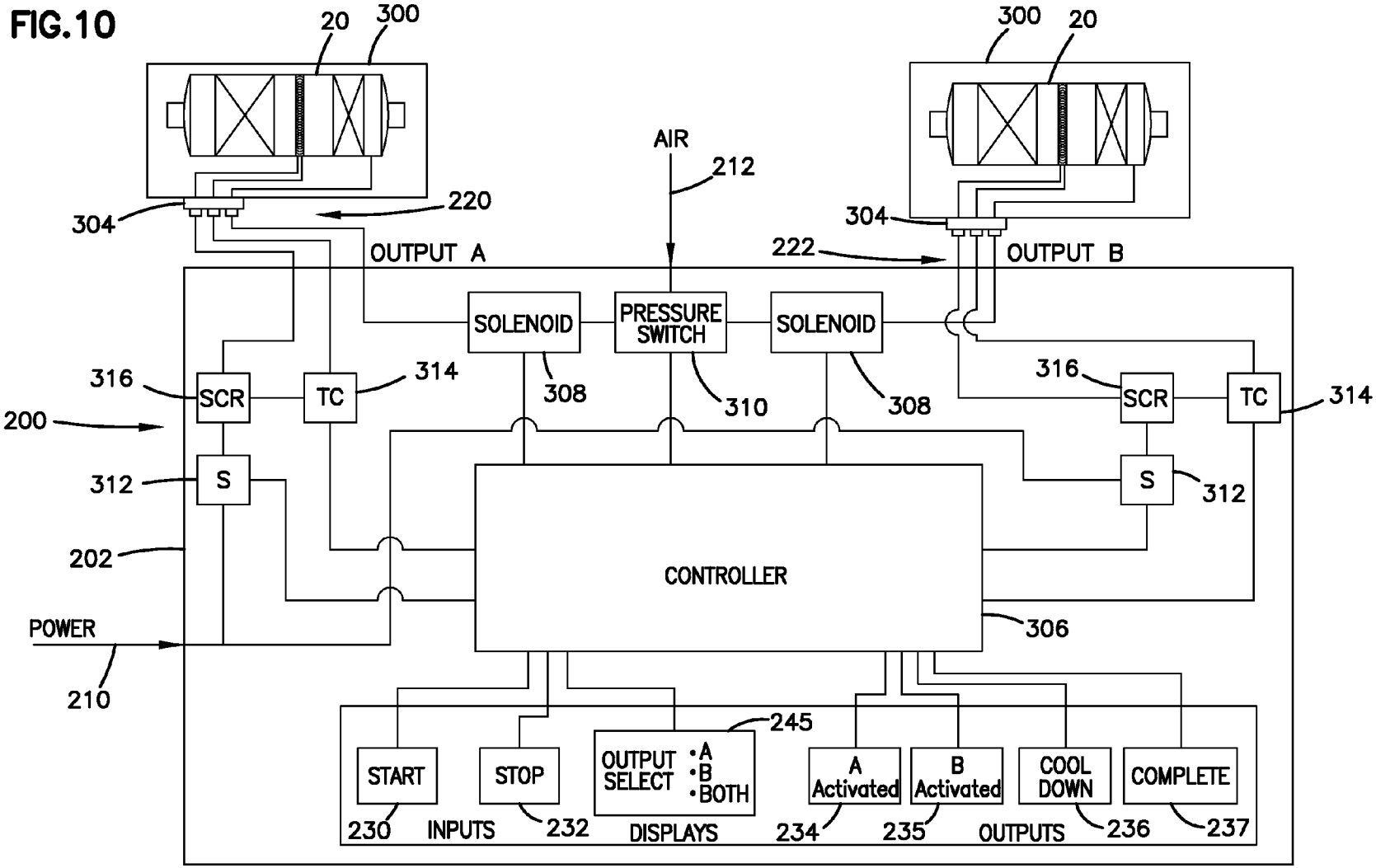
FIG. 10 is a high level schematic diagram of the shore station of FIG. 8.

FIGS. 1 and 2 illustrate a diesel engine exhaust treatment device 20 having features that are examples of inventive aspects in accordance with the principles of the present disclosure. The exhaust treatment device 20 includes an outer body 22 (e.g., a housing or conduit) having an inlet end 24 and an outlet end 26. The exhaust treatment device 20 also includes a diesel oxidation catalyst 28 (i.e., a catalytic converter/DOC) and a diesel particulate filter 30 (i.e., a DPF) positioned within the outer body 22. The DOC 28 is positioned upstream from the DPF 30. A heater 32 is positioned within the outer body 22 between the DOC 28 and the DPF 30. The heater 32 is adapted to selectively provide heat for regenerating the DPF 30. The exhaust treatment device 20 also includes a power line 34 for providing electricity to the heater 32, a thermocouple 36 for measuring the temperature of the heater 32, a back pressure sensor 38 for sensing the back pressure generated behind the DPF 30, and an air inlet 40 for providing combustion air within the outer body 22 during regeneration of the DPF 30. The exhaust treatment device 20 also includes a heat shield 42 that surrounds the outer body 22 along a region coinciding with the DOC 28, the heater 32 and the DPF 30. A controller (e.g., a controller provided at a shore station as shown at FIGS. 8-10) can be used to control the regeneration process. For example, the controller can be programmed with a regeneration recipe (e.g., regeneration protocol) that sets parameters such as regeneration heating temperatures, heating durations, cool-down durations, and air flow rates during heating and cool-down.

The outer body 22 of the exhaust treatment device 20 includes a cylindrical conduit structure 44 that extends from the inlet end 24 to the outlet end 26 of the outer body 22. The cylindrical conduit structure 44 includes a first section 46, a second section 48, a third section 50, a fourth section 52, and a fifth section 54. The first and fifth sections 46, 54 respectively define the inlet and outlet ends 24, 26 of the outer body 22. The second section 48 houses the DOC 28, the third section 50 houses the heater 32 and the fourth section 52 houses the DPF 30. Mechanical connection interfaces 56 are provided between the first and second sections 46, 48, between the second and third sections 48, 50, between the third and fourth sections 50, 52 and between the fourth and fifth sections 52, 54. The mechanical connection interfaces 56 are adapted to allow the various sections to be disconnected from one another to allow access to the interior of the outer body 22. In the depicted embodiment, mechanical connection interfaces 56 include joints 57 at which the sections are connected together. The sections include flanges 58 positioned at the joints. The flanges 58 are secured together by clamps such as V-band clamps 30 that prevent the sections from unintentionally separating at the joints 57. To facilitate assembly, selected sections can include pilot portions that fit into adjacent sections at the joints.

Referring to FIG. 2, the inlet end 24 of the outer body 22 is enclosed by an annular end cap 62 having an outer portion that is secured (e.g., circumferentially welded) to the first section 46 of the cylindrical conduit structure 44. An inlet pipe 64 extends through the center of the end cap 62 and is secured (e.g., circumferentially welded) to an inner portion the end cap 62. The inlet pipe 64 includes an outer end 66 that is slotted to facilitate clamping the outer end 66 to another exhaust pipe. The inlet pipe 64 also includes an inner end 68 that is covered by a flow dispersion plug 70. The flow dispersion plug 70 has a domed configuration and defines a plurality of flow dispersion openings 72. The flow dispersion plug 70 is designed to effectively distribute flow across the upstream face of the DOC 28.

The inlet pipe 64 also defines first and second sets of openings, 74, 76 that extend radially through the inlet pipe 64. The first set of openings 74 is adapted to direct exhaust flow radially outwardly from the inlet pipe 64. The first set of openings 74 cooperate with the flow dispersion plug 70 to provide flow uniformity at the upstream face of the DOC 28. The second set of openings 76 provide fluid communication between the interior of the inlet pipe 64 and a resonating chamber 78 (e.g., an expansion chamber). The resonating chamber 78 provides sound muffling within the exhaust treatment device 20. As depicted at FIG. 2, the resonating chamber 78 is defined between the end cap 62 and a baffle 80. The baffle 80 has an outer edge secured (e.g., circumferentially welded) to the cylindrical conduit section 44 and an inner edge secured (e.g., circumferentially welded) to the outer surface of the inlet pipe 64. Openings 82 can be defined through the baffle 80.

Referring still to FIG. 2, the air inlet 40 includes a nozzle member 84 having a stem 88 that extends through the cylindrical conduit section 44 of the outer body 22 and also extends through the inlet pipe 64. A discharge end 86 of the nozzle member 84 is located within the interior of the inlet pipe 64. The discharge end 86 of the nozzle member 84 is curved 90° relative to the stem 88 of the nozzle member. The stem 88 is aligned generally perpendicular to a central longitudinal axis 90 of the cylindrical conduit section 44, and the discharge end 86 is generally centered on the longitudinal axis such that air from the discharge end 86 is injected in a direction parallel to the longitudinal axis 90.

Figure 3:
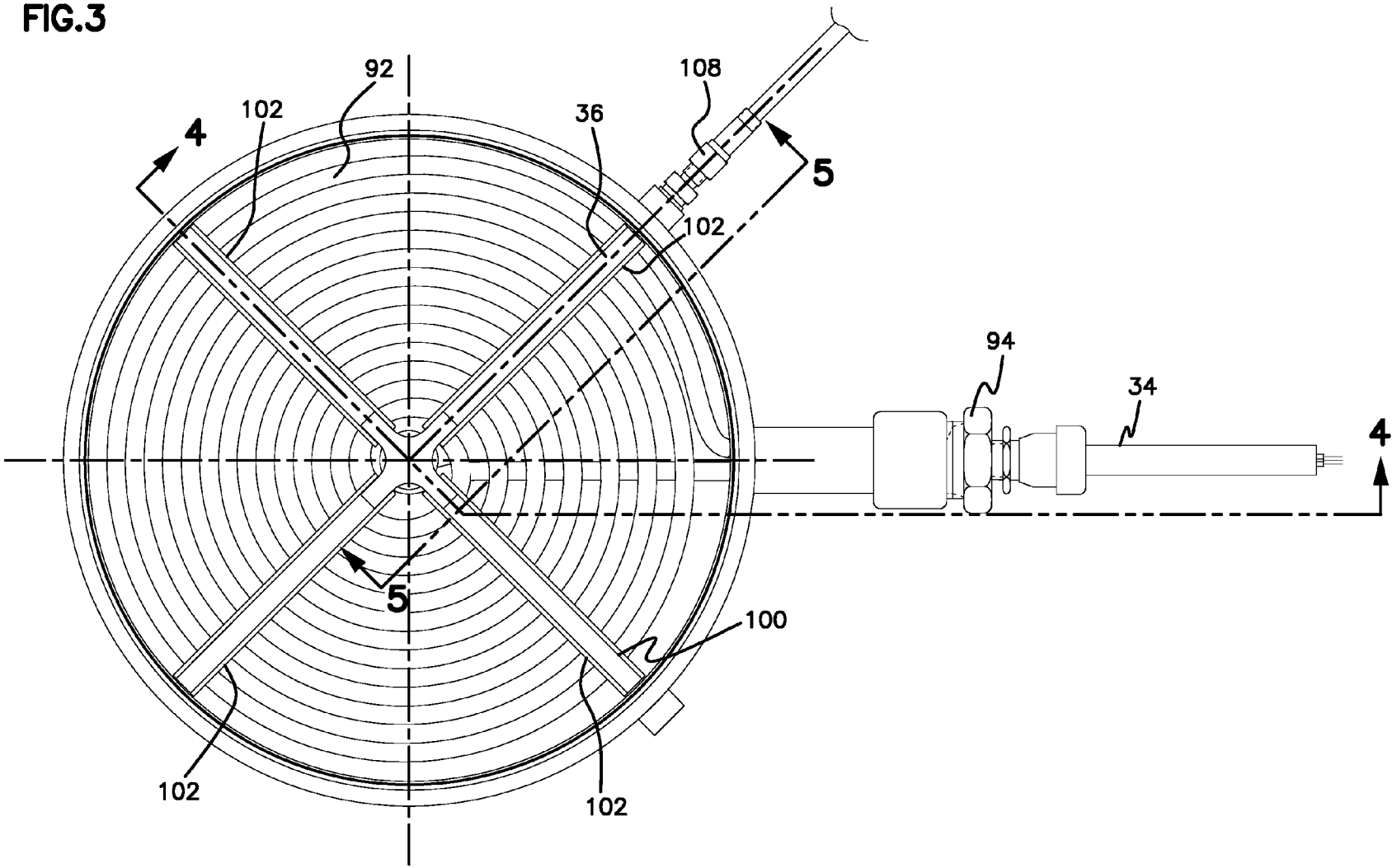
FIG. 3 is an end view of a heating element used in the exhaust treatment device of FIGS. 1 and 2.

As depicted at FIG. 2, the heater 32 is mounted within the third section 50 of the cylindrical conduit section 44 at a location between the DPF 30 and the DOC 28. As shown at FIG. 3, the heater 32 includes a resistive heating element 92 that extends in a spiral pattern. A coupler 94 connects the power line 34 to the resistive heating element 92 so that electricity can be directed through the resistive heating element 92 when it is desired to generate heat for regenerating the DPF 30. The resistive heating element 92 is secured (e.g., welded, clamped, strapped, wired, adhered or otherwise connected) to a stabilizing bracket 100 located at a downstream face of the resistive heating element 92. The bracket 100 includes four stabilizing members 102 that project radially outwardly from the center longitudinal axis 90 of the cylindrical conduit section 44. Outer ends of the stabilizing member 102 are secured to the third section 50 of the cylindrical conduit structure 44. As depicted in FIG. 3, the stabilizing members 102 are offset approximately 90° relative to one another so as to define a generally "cross-shaped" or "plus-shaped" configuration. As shown at FIG. 5, each of the stabilizing members 102 has a generally U-shaped transverse cross section.

Figure 4:
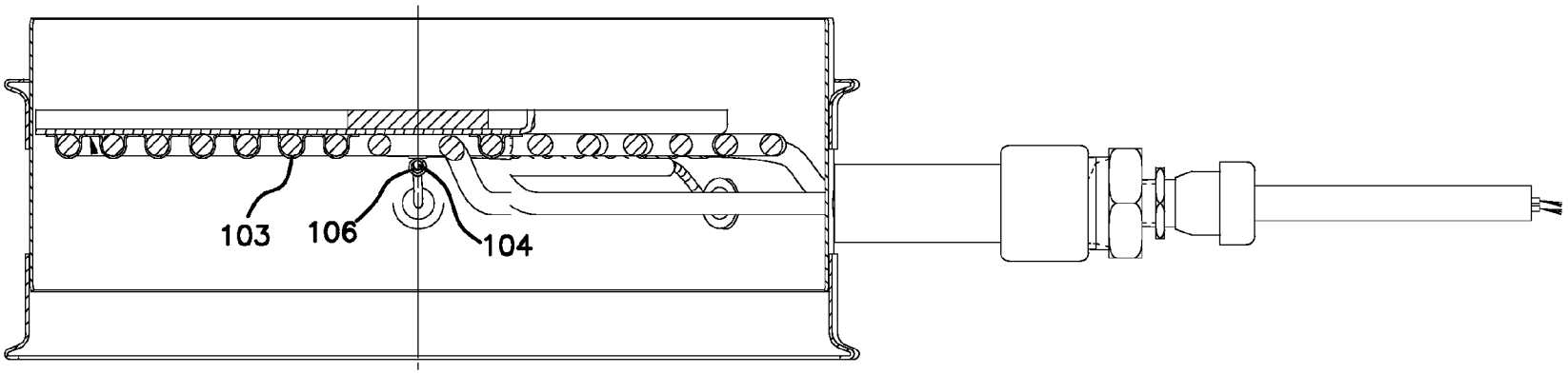
FIG. 4 is a cross-sectional view taken along section line 4-4 of FIG. 3.
Figure 5:
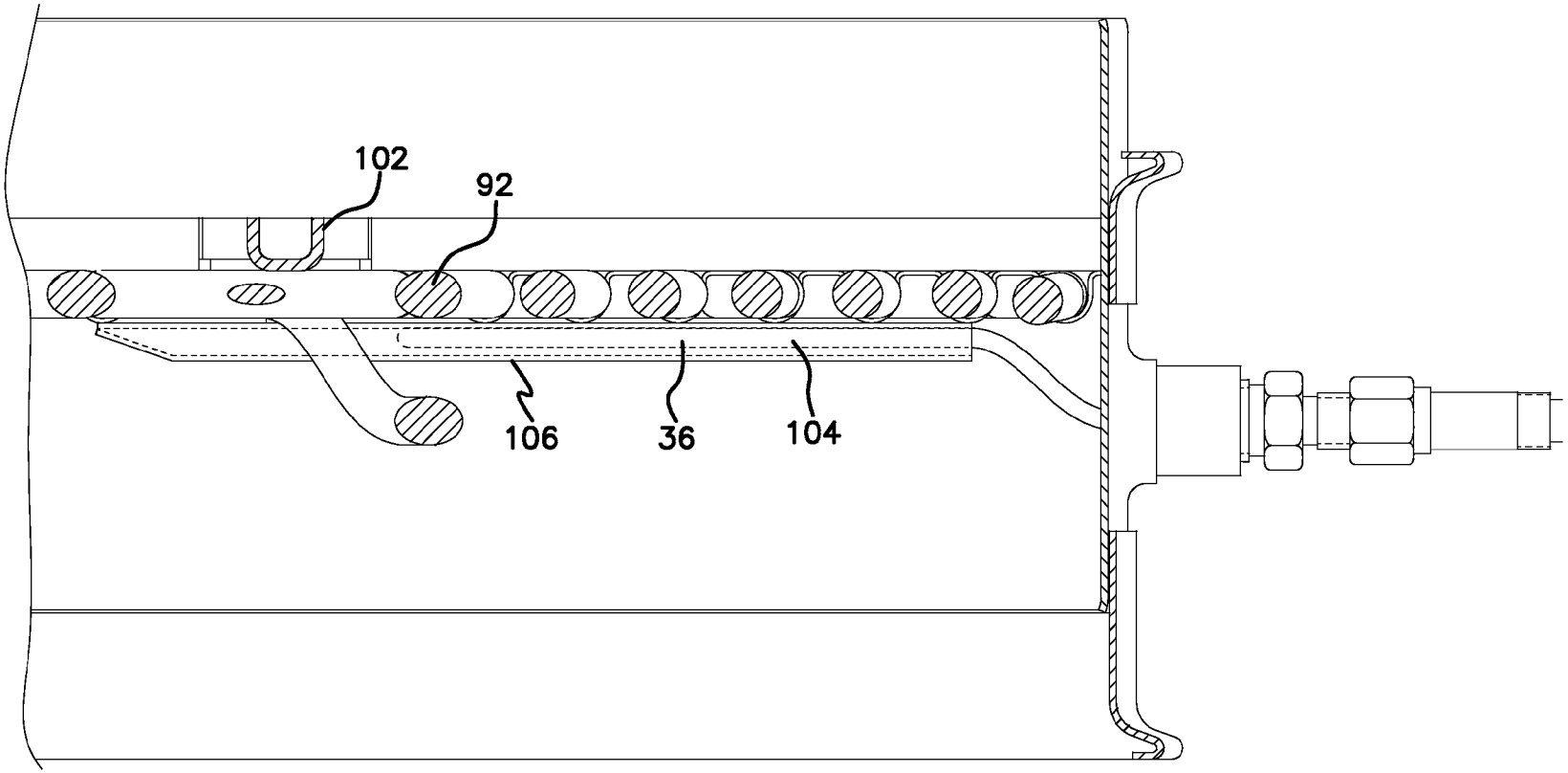
FIG. 5 is a cross-sectional view taken along section line 5-5 of FIG. 3.

Referring to FIGS. 3-5, a temperature sensing probe 104 of the thermocouple 36 is mounted to the resistive heating element 92. The probe 104 is located at an upstream side of the resistive heating element 92. The probe 104 is shown mounted to the resistive heating element 92 through the use of a well 106 secured to the upstream side of the resistive heating element 92. As shown at FIG. 5, the well 106 has a hollow interior (i.e., an inner channel) for receiving the probe 104. A coupling 108 secures the thermocouple 36 to the cylindrical conduit section 44. By detaching the coupling 108, the temperature probe 104 can be withdrawn from the well 106 and replaced with a new probe or repaired in the event of probe failure.

Referring back to FIG. 2, the outlet end 26 of the main body 22 of the exhaust treatment device 20 is enclosed by an annular end cap 110. An outlet pipe 116 extends through the center of the end cap 110. The end cap 110 has an outer portion that is secured (e.g., circumferentially welded) to the cylindrical conduit structure 44, and an inner portion that is secured (e.g., circumferentially welded) to the outer surface of the outlet pipe 116. The outlet pipe 116 has an outer end 118 that is slotted to facilitate connecting the outlet pipe 116 to another pipe (e.g., to a stack) and an inner end 120 that is outwardly flared to form a bell-mouth. A resonating chamber 122 is provided around the outlet pipe 116 for muffling sound. The resonating chamber 122 is defined between the end cap 110 and a perforated baffle 124. A plurality of openings 126 are defined radially through the outlet pipe 116 to provide a fluid communication between the interior of the outlet pipe 116 and the interior of the resonating chamber 122.

Figure 6:
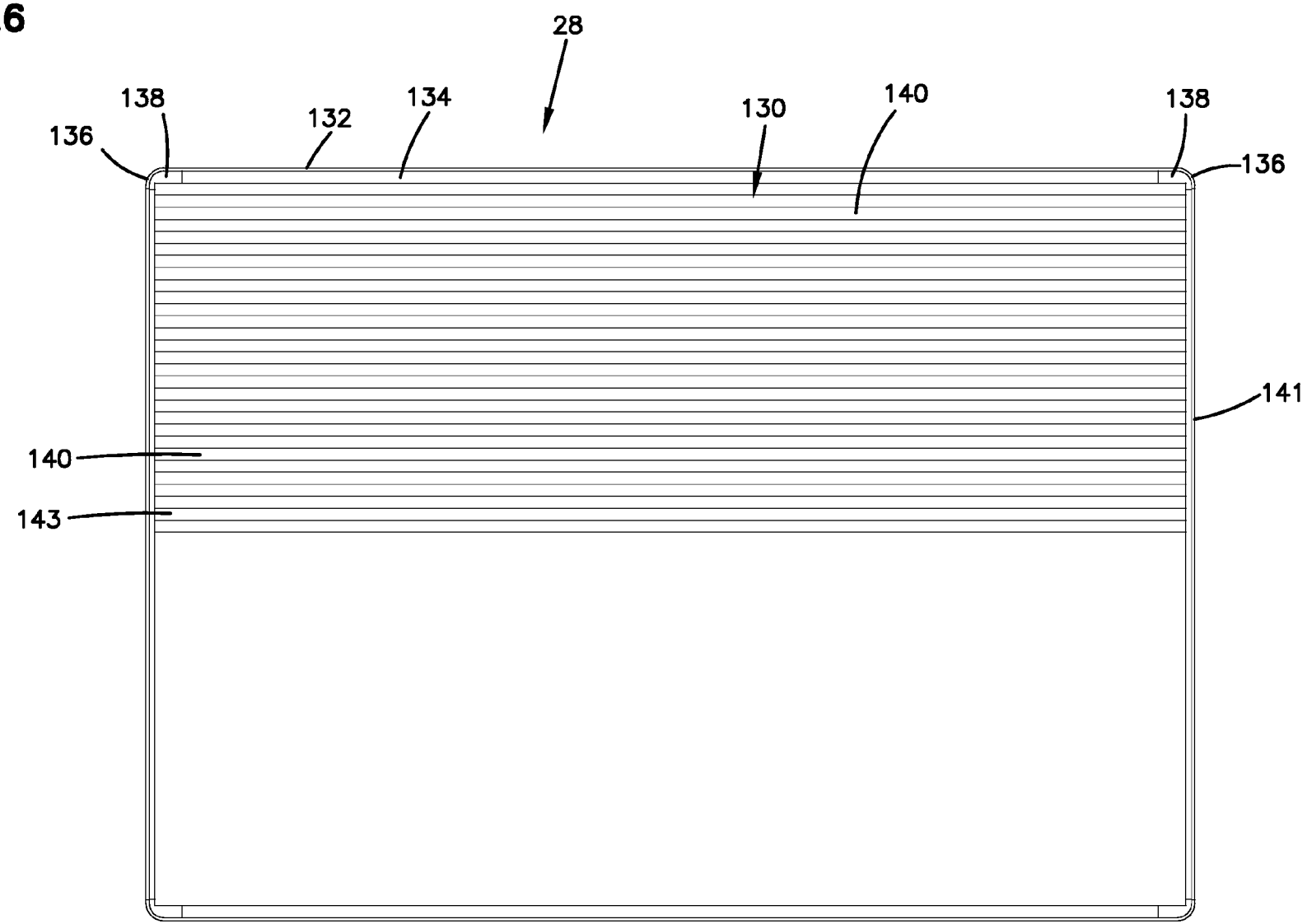
FIG. 6 is an enlarged view of a catalytic converter used in the exhaust treatment device of FIGS. 1 and 2.

The DOC 28 of the exhaust treatment device 20 is used to convert carbon monoxide and hydrocarbons in the exhaust stream into carbon dioxide and water. As shown at FIG. 6, the DOC 28 is depicted having a substrate 130 housed within an outer casing 132. In certain embodiments, the substrate 130 can have a ceramic (e.g., a foamed ceramic) monolith construction. A mat layer 134 can be mounted between the substrate 130 and the casing 132. Ends 136 of the casing can be bent radially inwardly to assist in retaining the substrate 130 within the casing 132. Gaskets 138 can be used to seal the ends of the DOC 28 to prevent flow from passing through the mat layer 134 to by-pass the substrate 130.

Referring still to FIG. 6, the substrate 130 is depicted defining a honeycomb arrangement of longitudinal passages 140 (i.e., channels) that extend from an upstream end 141 to a downstream end 143 of the substrate 130. The passages 140 are preferably not plugged so that flow can readily travel through the passages 140 from the upstream end 141 to the downstream end 143 of the substrate 130. As exhaust flow travels through the substrate 130, soluble organic fraction within the exhaust can be removed through oxidation within the oxidation catalyst device.

The particulate mass reduction efficiency of the DOC is dependent upon the concentration of particulate material in the exhaust stream being treated. Post 1993 on-road diesel engines (e.g., four stroke 150-600 horsepower) typically have particulate matter levels of 0.10 grams/brake horsepower hour (bhp-hr) or better. For treating the exhaust stream of such engines, the DOC may have a particulate mass reduction efficiency of 25% or less. In other embodiments, the DOC may have a particulate mass reduction efficiency of 20% or less. For earlier model engines having higher PM emission rates, the DOC may achieve particulate mass reduction efficiencies as high as 50 percent.

For the purposes of this specification, particulate mass reduction efficiency is determined by subtracting the particulate mass that enters the DOC from the particulate mass that exits the DOC, and by dividing the difference by the particulate mass that enters the DOC. The test duration and engine cycling during testing are preferably determined by the federal test procedure (FTP) heavy-duty transient cycle that is currently used for emission testing of heavy-duty on-road engines in the United States (see C.F.R. Tile 40, Part 86.1333). Carbon monoxide and other contaminants can also be oxidized within the DOC.

It will be appreciated that unlike filters which rely primarily on mechanically capturing particulate material within a filter media, catalytic converters rely on catalyzed oxidation to remove particulate material from an exhaust stream. Therefore, catalytic converters are typically adapted to resist particulate loading. For example, a typical catalytic converter substrate has passages that extend completely from the upstream end of the substrate to the downstream end of the substrate. In this way, flow is not forced through the walls of the substrate. The channels are preferably large enough in cross-sectional area to prevent particulate material from accumulating on the substrate.

Suitable catalytic converter substrates can have a variety of other configurations. Example catalytic converter configurations having both corrugated metal and porous ceramic substrates/cores are described in U.S. Pat. No. 5,355,973, that is hereby incorporated by reference in its entirety. In certain embodiments, the DOC can be sized such that in use, the catalytic converter has a space velocity (volume metric flow rate through the DOC divided by the volume of the DOC) less than 150,000 per hour or in the range of 50,000 to 150,000 per hour. In one example embodiment, the DOC substrate can have a cell density of at least 200 cells per square inch, or in the range of 200 to 400 cells per square inch. Exemplary materials for manufacturing the DOC substrate include cordierite, mullite, alumina, SiC, refractory metal oxides, or other materials conventionally used as substrate.

The substrate 130 preferably includes a catalyst. For example, the substrate 130 can be made of a catalyst, impregnated with a catalyst or coated with a catalyst. Example catalysts include precious metals such as platinum, palladium and rhodium. In a preferred embodiment, the DOC substrate is lightly catalyzed with a precious metal catalyst. For example, in one embodiment, the DOC substrate has a precious metal loading (e.g., a platinum loading) of 15 grams or less per cubic foot. In another embodiment, the DOC substrate has a precious metal loading (e.g., a platinum loading) equal to or less than 10 grams per cubic feet or equal to or less than 5 grams per cubic foot. By lightly catalyzing the DOC substrate, the amount of $NO_2$ generated at the DOC substrate during treatment of exhaust is minimal. The catalysts can also include other types of materials such as alumina, cerium oxide, base metal oxides (e.g., lanthanum, vanadium, etc.) or zeolites. Rare earth metal oxides can also be used as catalysts.

The DOC 20 is preferably positioned relatively close to the resistive heating element 92. For example, in one embodiment, the downstream face of the DOC is spaced a distance ranging from 1 to 4 inches from the upstream face of the resistive heating element 92. During regeneration, the DOC functions to store heat thereby heating the combustion air that flows to the DPF. Additionally, the DOC functions to reflect heat back towards the DPF. Moreover, the DOC assists in providing a dry soot pack at the DPF thereby facilitating the regeneration process.

Referring back to FIG. 2, the DPF 30 is mounted in the fourth section 52 of the cylindrical conduit structure 44. In one embodiment, an upstream face of the DPF 30 is positioned within the range of 1-4 inches of the downstream face of the resistive heating element 92.

Figure 7:
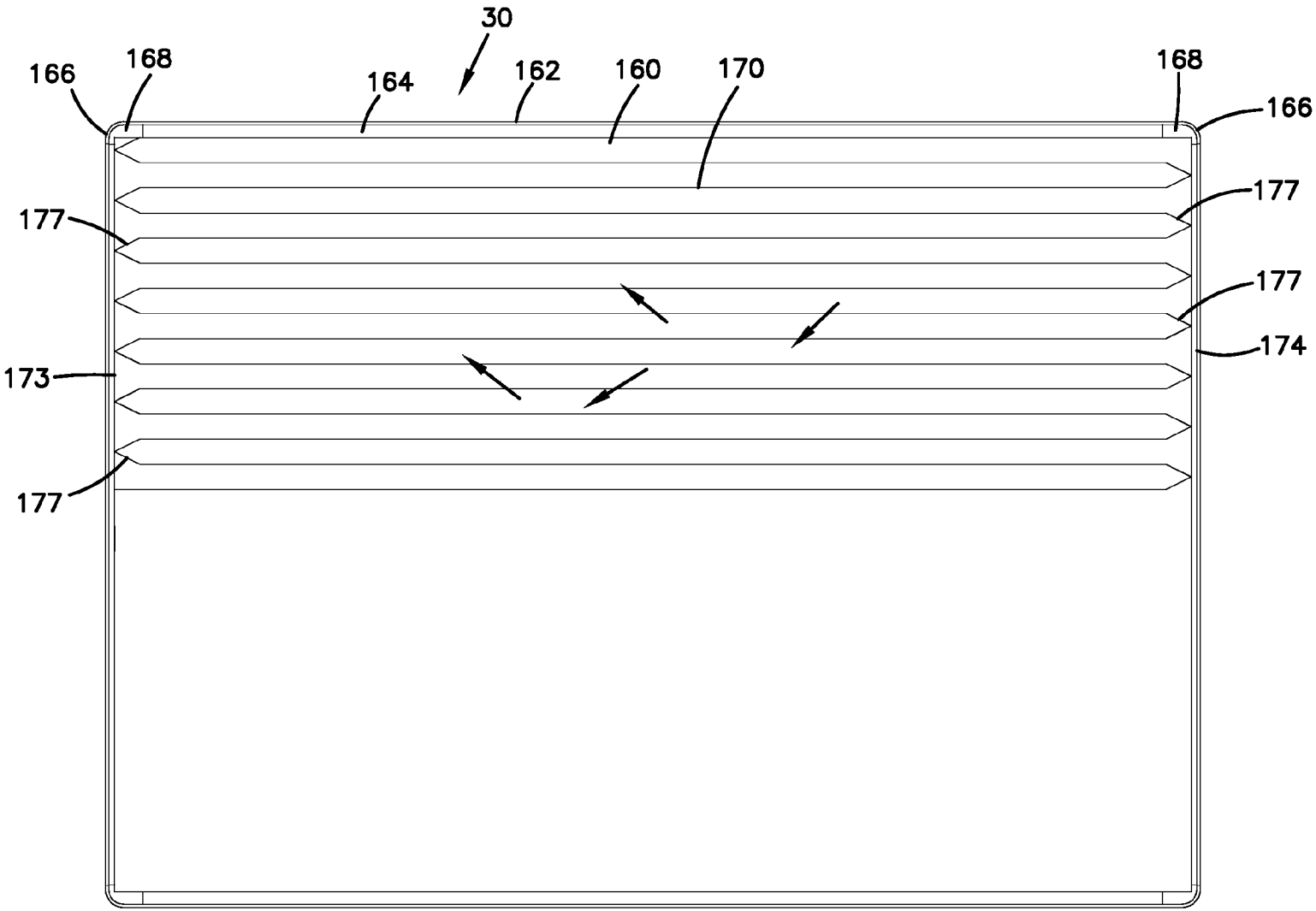
FIG. 7 is an enlarged view of a diesel particulate filter used in the exhaust treatment device of FIGS. 1 and 2.

As shown at FIG. 7, the DPF 30 is depicted as wall-flow filter having a substrate 160 housed within an outer casing 162. In certain embodiments, the substrate 160 can have a silicon carbide (SiC) construction including multiple pie-shaped segments mounted together. A mat layer 164 can be mounted between the substrate 160 and the casing 162. Ends 166 of the casing can be bent radially inwardly to assist in retaining the substrate 160 within the casing 162. End gaskets 168 can be used to seal the ends of the DPF 30 to prevent flow from passing through the mat layer 164 to bypass the substrate 160.

Still referring to FIG. 7, the substrate includes walls 170 defining a honeycomb arrangement of longitudinal passages 172 (i.e., channels) that extend from a downstream end 173 to an upstream end 174 of the substrate 160. The passages 172 are selectively plugged adjacent the upstream and downstream ends 173, 174 such that exhaust flow is forced to flow radially through the walls 170 between the passages 172 in order to pass through the DPF 30. As shown at FIG. 7, this radial wall flow is represented by arrows 176. In the embodiment of FIG. 7, the ends of the channels are plugged by pinching the ends 177 of the channels together during the fabrication process of the substrate 160. This causes the open ends of the channels adjacent the upstream face of the DPF to be funneled to resist face plugging. In alternative embodiments, the ends of the channels can be closed by standard plug configurations rather than being pinched closed.

In alternative embodiments, the diesel particulate filter can have a configuration similar to the diesel particulate filter disclosed in U.S. Pat. No. 4,851,015 that is hereby incorporated by reference in its entirety. Example materials for manufacturing the DPF substrate include cordierite, mullite, alumina, SiC, refractory metal oxides or other materials conventionally used at DPF substrates.

It is preferred for the DPF to be lightly catalyzed or to not be catalyzed at all. In a preferred embodiment, the DPF has a precious metal loading that is less than the precious metal loading of the DOC. By minimizing the precious metal loading on the DPF, the production of $NO_2$ during treatment of exhaust is minimized.

The DPF 30 preferably has a particulate mass reduction efficiency greater than 75%. More preferably, the DPF 30 has a particulate mass reduction efficiency greater than 85%. Most preferably, the DPF 30 has a particulate mass reduction efficiency equal to or greater than 90%. For the purposes of this specification, particulate mass reduction efficiency is determined by subtracting the particulate mass that enters the DPF from the particulate mass that exits the DPF, and by dividing the difference by the particulate mass that enters the DPF. The test duration and engine cycling during testing are preferably determined by the federal test procedure (FTP) heavy-duty transient cycle that is currently used for emission testing of heavy-duty on-road engines in the United States (see C.F.R. Tile 40, Part 86.1333).

To facilitate regeneration, it is preferred for the DPF to have a relatively low concentration of cells per square inch. For example, in one embodiment, the DPF has less than or equal to 150 cells per square inch. In another embodiment, the DPF has less than or equal to 100 cells per square inch. In a preferred embodiment, the DPF has approximately 90 cells per square inch. By using a relatively low concentration of cells within the DPF substrate, it is possible for the substrate walls 170 defining the passages 172 to be relatively thick so that the walls are less prone to cracking. In one embodiment, the walls 170 have a thickness of in the range of 0.010-030 inches.

It is desired for the device 20 to not cause substantial increases in the amount of $NO_2$ within the exhaust stream. In a preferred embodiment, the ratio of $NO_2$ to $NO_x$ in the exhaust gas downstream from the exhaust treatment system is no more than 20 percent greater than the ratio of $NO_2$ to $NO_x$ in the exhaust gas upstream from the exhaust treatment system. In other words, if the engine-out NOx mass flow rate is $(NO_x)_{eng}$, the engine-out $NO_2$ mass flow rate is $(NO_2)_{eng}$, and the exhaust-treatment-system-out $NO_2$ mass flow rate is $(NO_2)_{sys}$, then the ratio $$\frac{(NO2)sys - (NO2)eng}{(NOx)eng}$$

is less than 0.20. In other embodiments, the ratio is less than 0.1 or less than 0.05.

In still other embodiments, the ratio of $NO_2$ to $NO_x$ in the exhaust gas between the DOC and the DPF is no more than 20 percent greater than the ratio of $NO_2$ to $NO_x$ in the exhaust gas upstream from the DOC. In other embodiments, the ratio of $NO_2$ to $NO_x$ in the exhaust gas between the DOC and the DPF is no more than 10 percent greater or no more than 5 percent greater than the ratio of $NO_2$ to $NO_x$ in the exhaust gas upstream from the DOC.

The back pressure sensor 38 of the exhaust treatment device 20 measures the back pressure generated behind the DPF 30. In certain embodiments, the back pressure monitor interfaces with an indicator provided in the cab of the vehicle on which the exhaust treatment device 20 is installed. When the back pressure exceeds a predetermined amount, the indicator (e.g., a light) provides an indication to the driver that the exhaust treatment device is in need of regeneration.

It will be appreciated that power and combustion air for the exhaust treatment device can be provided from either an onboard source or an offboard source. For example, vehicles may be equipped with onboard generators, controllers and sources of compressed air to provide onboard power, air and regeneration control to the exhaust treatment device 20. Alternatively, an offboard station can be used to provide power, regeneration control and combustion air to the exhaust treatment device. Offboard stations are particularly suitable for use in regenerating exhaust treatment devices installed on domiciled fleets (e.g., buses) that are periodically parked (e.g., nightly) at a given location. In still other embodiments, regeneration control may be provided onboard, while air and power are provided offboard.

FIG. 8 shows an example shore station 200 adapted for use with the exhaust treatment device 20. The shore station 200 includes a control unit 202 having a housing 204 mounted on wheels 206 so as to form a wheeled cart. A power cord 210 provides electricity to the control unit 202. In one embodiment, the electricity is provided from a 208 VAC/240 VAC power source. An air line 212 places the controller in fluid communication with a source of compressed air. As shown in FIG. 8, the shore station 200 also includes two regeneration cords 220, 222 that extend outwardly from the housing 204. Each of the cords 220, 222 include a power line 224, a thermocouple line 226 and a combustion air line 228. Because two regeneration cords 220, 222 are provided, the control unit 202 is able to control the regeneration of two exhaust treatment devices 20 at the same time. In certain embodiments, the control unit 202 can be adapted to alternate the voltage provided to the first and second regeneration cords 220, 222 so that power is only provided to one of the heaters at a given point in time. For example, the control unit 202 can be adapted to modulate power back and forth between the heaters of the two exhaust treatment devices being regenerated so as to maintain the temperatures of the heaters at a given level without requiring power to be provided to both heaters at the same time. While the shore station 200 is shown including two regeneration lines 220, 222 per control unit, it will be appreciated that in other embodiments 3, 4, 5, 6 or more regeneration lines can be provided per control unit.

The control unit is preferably equipped with a control panel. An example control panel is shown at FIG. 9. Referring to FIG. 9, the control panel includes a start button 230 and an emergency stop button 232. The control panel also includes four indicator lights 234-237. Indicator light 234 is illuminated when a first exhaust treatment device is coupled to the first cord 220 and is in the process of being regenerated. The second light 235 is illuminated when a second exhaust treatment device is coupled to the control unit through the second cord 222 and is in the process of being regenerated. The third light 236 is illuminated when the exhaust treatment devices are in the cool down phase. The fourth light 237 is illuminated when regeneration is complete. The display also includes temperature displays 240, 241 for displaying the goal temperatures and actual temperatures of the thermocouples of the exhaust treatment devices being serviced by the shore station. The control panel further includes a dial switch 245 for selecting the first regeneration cord 220 for use, the second regeneration 222 cord for use, or both regeneration cords for use at the same time.

Figure 11:
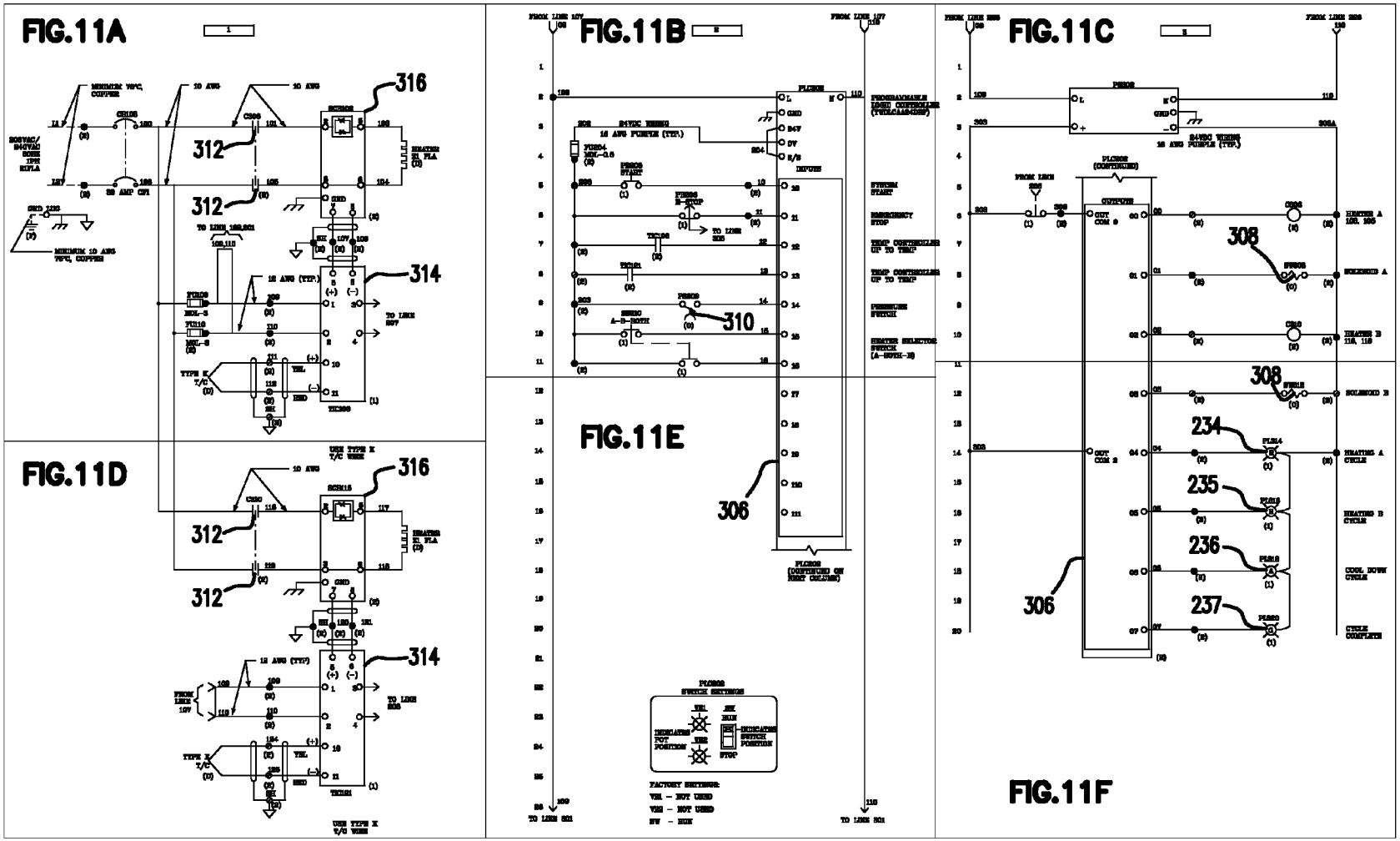
FIG. 11 is a more detailed schematic diagram illustrating the shore station of FIG. 8.
Figure 11A:
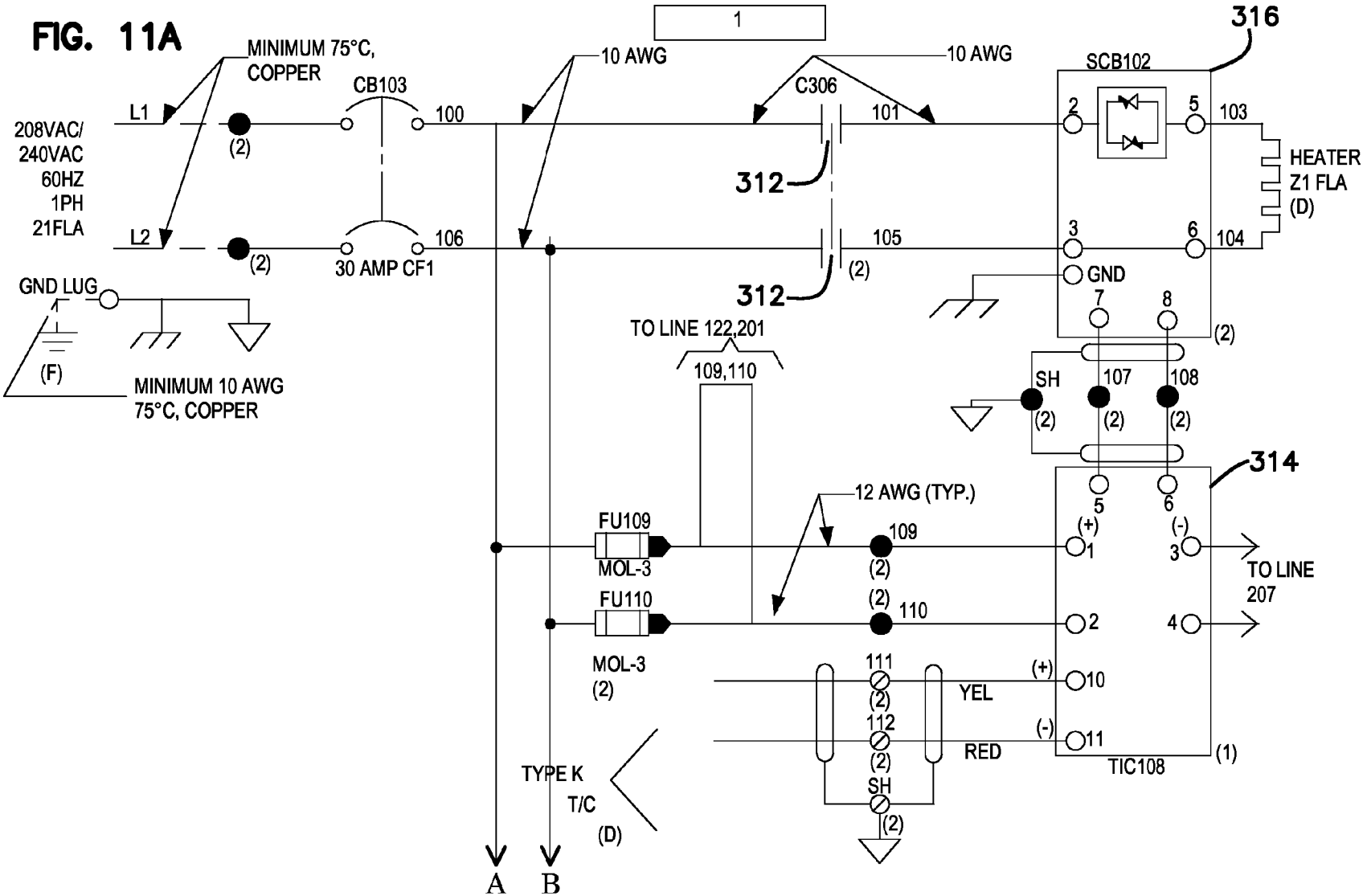
FIG. 11A is a close-up view illustrating portion FIG. 11A of the schematic diagram of FIG. 11.
Figure 11B:
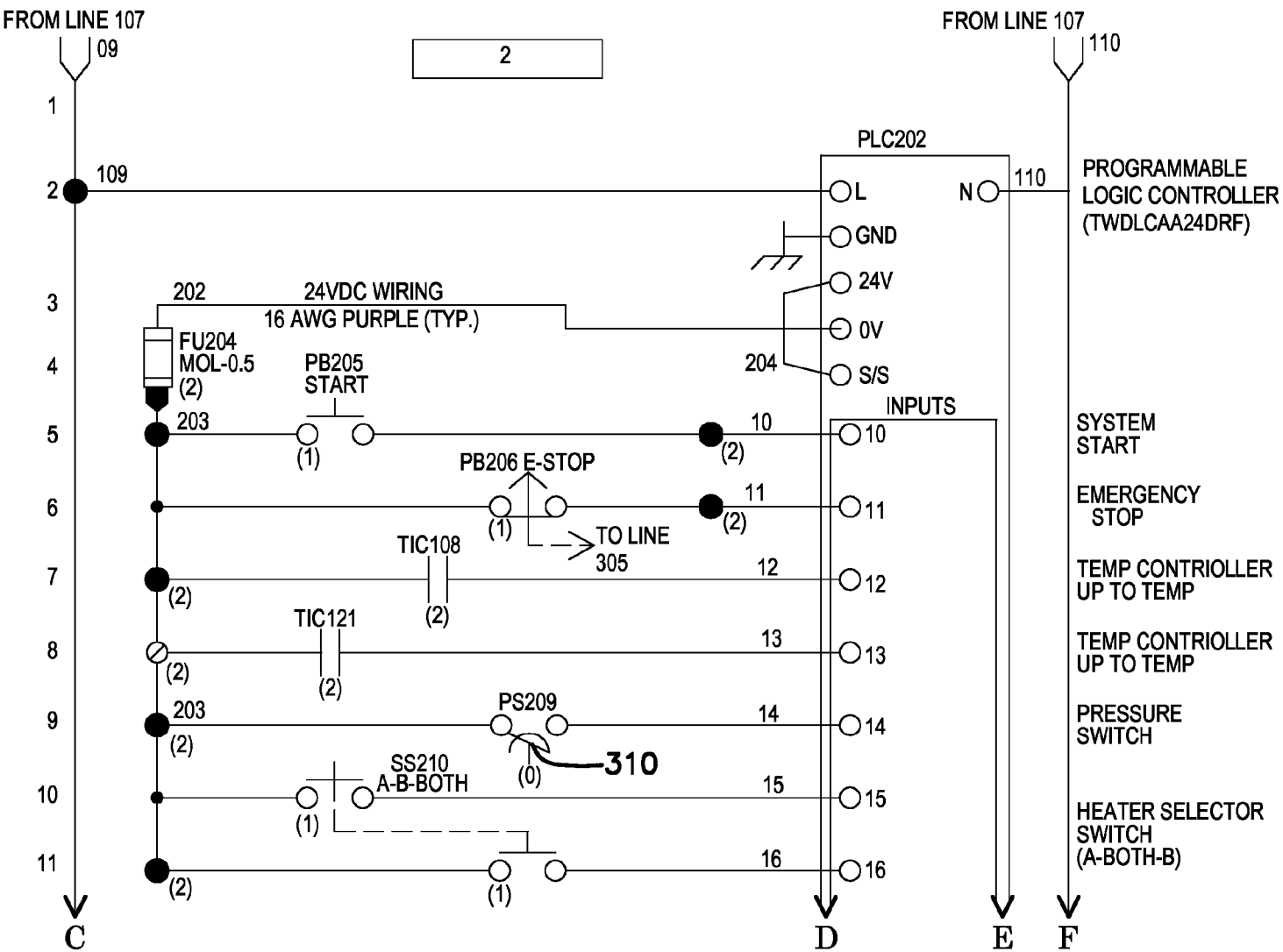
FIG. 11B is a close-up view illustrating portion FIG. 11B of the schematic diagram of FIG. 11.
Figure 11C:
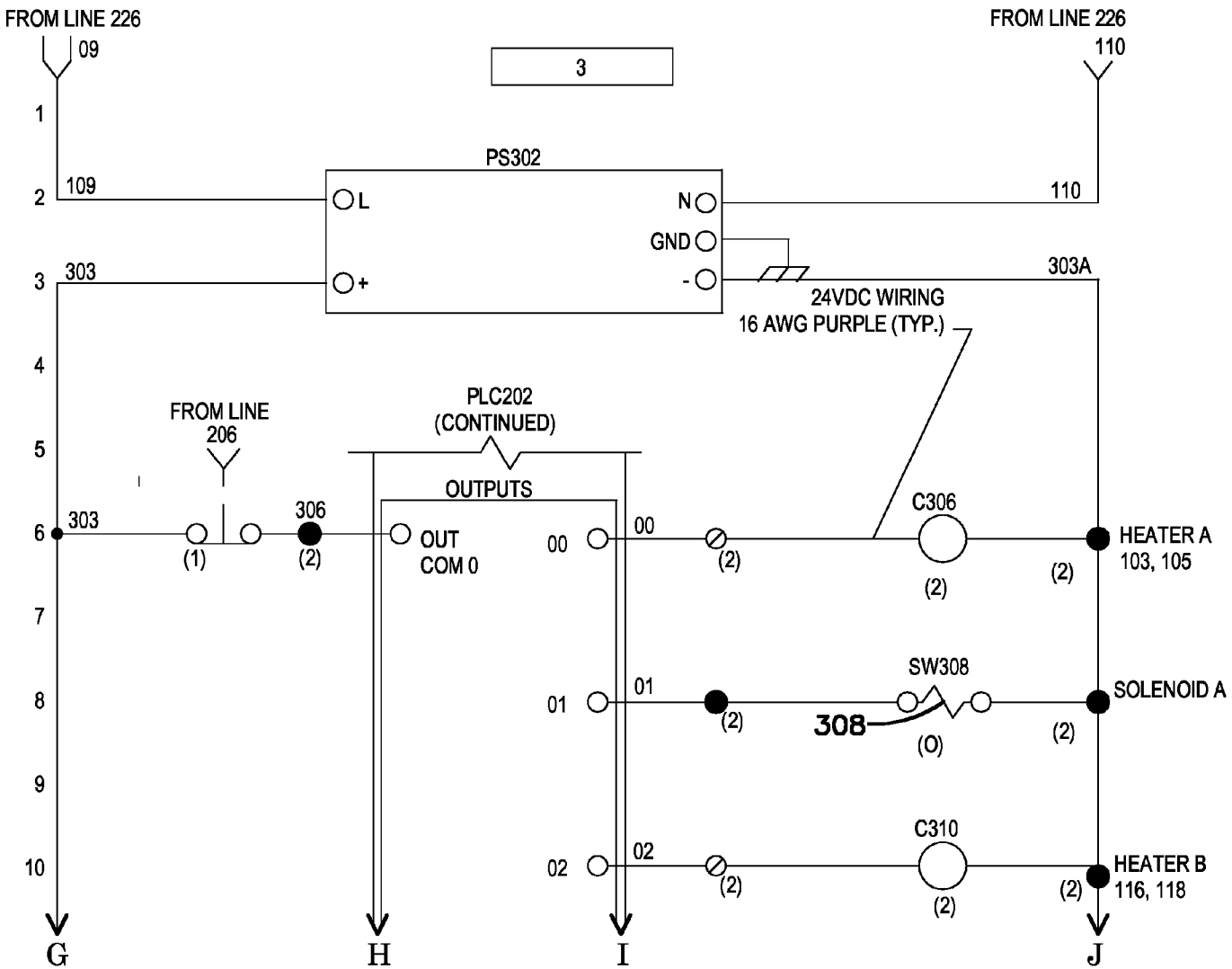
FIG. 11C is a close-up view illustrating portion FIG. 11C of the schematic diagram of FIG. 11.
Figure 11D:
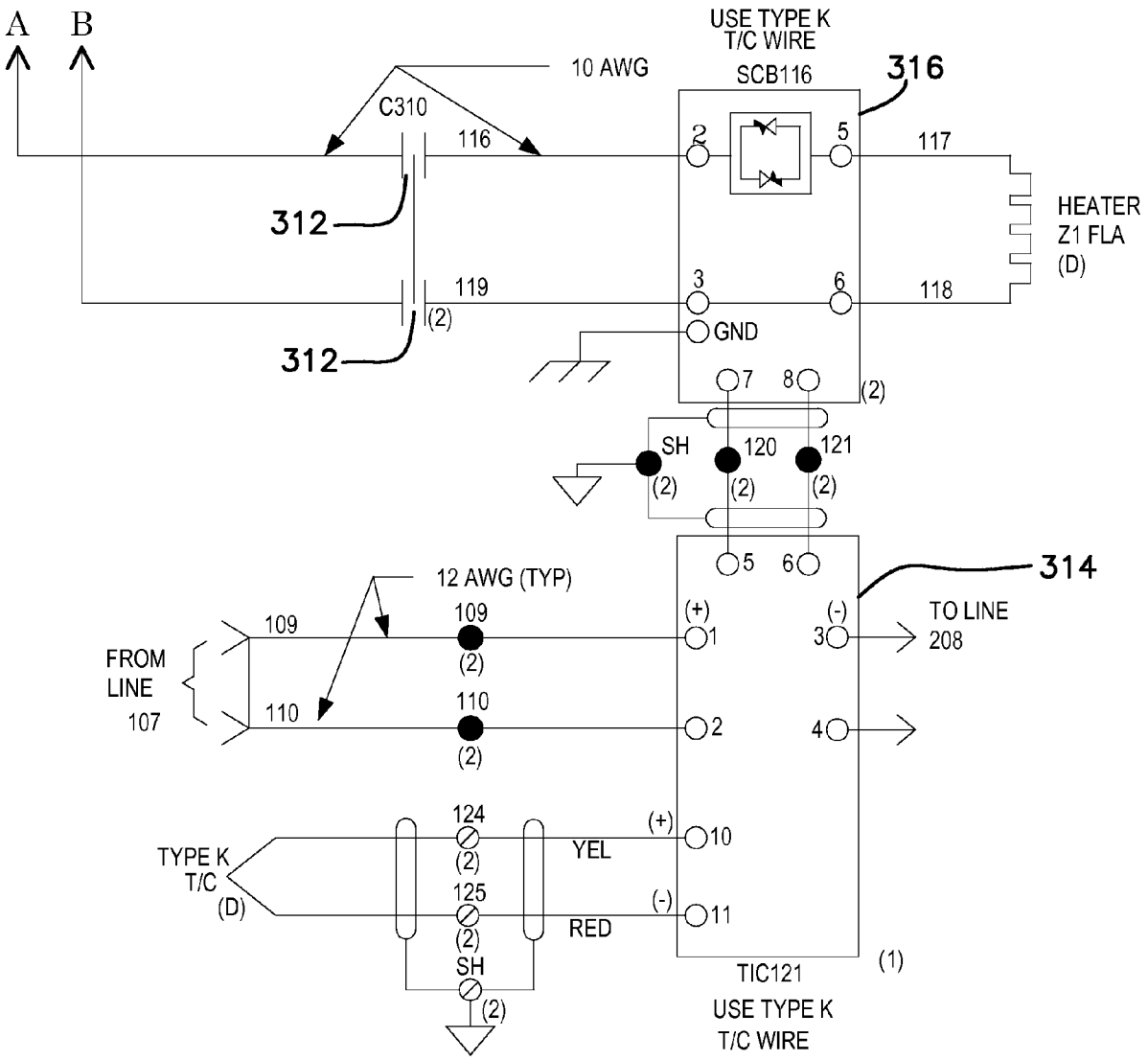
FIG. 11D is a close-up view illustrating portion FIG. 11D of the schematic diagram of FIG. 11.
Figure 11E:
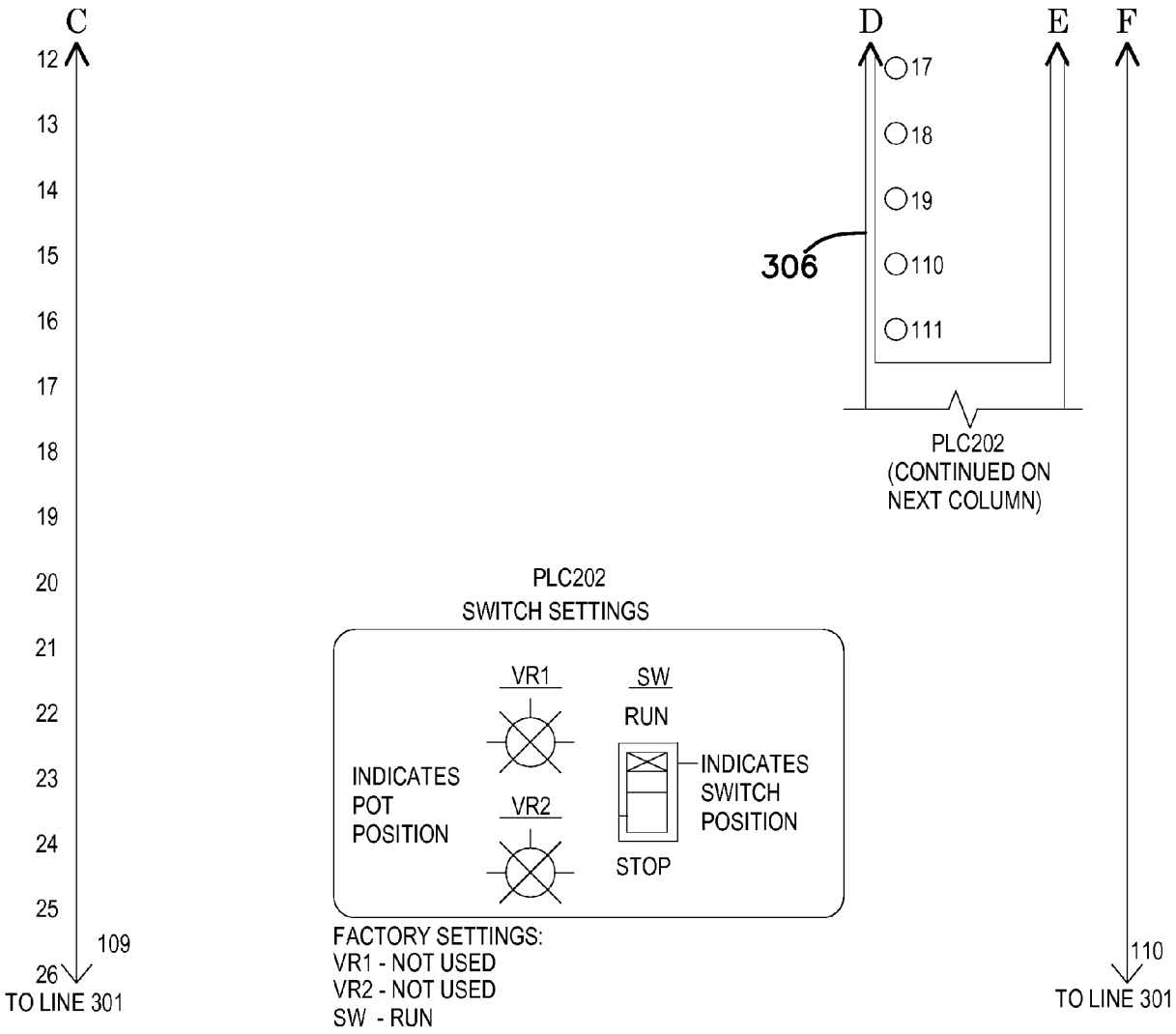
FIG. 11E is a close-up view illustrating portion FIG. 11E of the schematic diagram of FIG. 11.
Figure 11F:
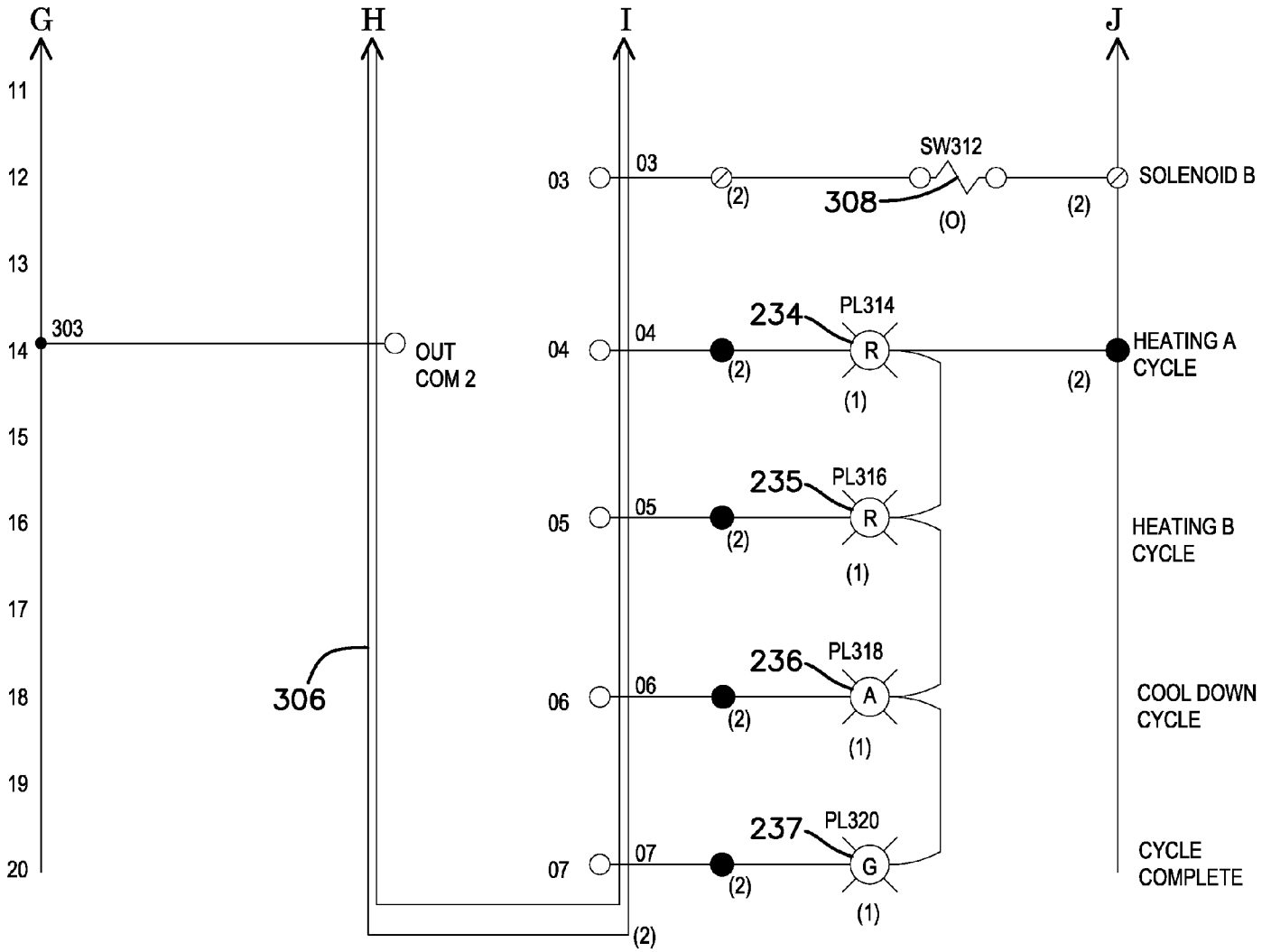
FIG. 11F is a close-up view illustrating portion FIG. 11F of the schematic diagram of FIG. 11.

FIGS. 10 and 11 schematically show the shore station 200. At FIG. 10, the control unit 202 of the shore station 200 is shown in the process of controlling the regenerations of exhaust treatment devices 20 provided on first and second vehicles 300 and 302. The vehicles 300, 302 include bulkheads 304 for facilitating connecting the regeneration cords 220, 222 to the exhaust treatment devices 20 of the vehicles 300, 302. A controller 306 is positioned within the housing 204 of the control unit 202. The controller 306 controls the actuation of solenoids 308 that selectively open and close fluid communication between the air line 212 and the exhaust treatment devices 20. The controller 306 also interfaces with a pressure switch 308 that measures the pressure provided by the air line 212. If the pressure falls below a predetermined level for a predetermined amount of time (e.g., 60 pounds per square inch for 3 seconds), the controller can be adapted to abort a regeneration sequence.

The control unit 202 also controls the power provided to the exhaust treatment devices 20 being regenerated. For example, the control unit 202 includes switches 312 that interface with the controller 306. The switches 312 allow the controller 306 to selectively start or stop power from being supplied to the heating elements of the exhaust treatment devices 20. Temperature controllers 314 also assist in controlling operation of the heating elements of the exhaust treatment devices 20. The temperature controllers 314 receive temperature feedback from the thermocouples of the exhaust treatment devices 20. The temperature controllers 314 interface with switches 316 (e.g., silicon control rectifiers) that control the power provided to the heating elements. The temperature controllers 314 can be programmed to control the switches 316 so that the heating elements of the exhaust treatment devices 20 are heated to a desired temperature. The temperature controllers 314 can include displays for displaying the set/desired regeneration temperature, and also for displaying the actual temperature of the heating element as indicated from data provided by the thermocouple. The temperature controllers 314 interface with the controller 306 to provide feedback regarding the temperature of the heating elements. In the event that the heating elements heat too slowly or become overheated, the controller will discontinue the regeneration process by actuating the switches 312 so that no additional power is provided to the heating element.

When multiple exhaust treatment devices 20 are being regenerated, the controller will alternately open and close the switches 312 so that power alternates between the heating elements of the exhaust treatment devices.

In use of the shore station 200, the regeneration cord 220 is plugged into the bulkhead 304 of a vehicle 300. By plugging the regeneration cord 220 into the bulkhead 304, the shore station 200 can provide power and air to the exhaust treatment devices 20 during regeneration, can monitor the temperature of the heating elements, and can control the regeneration process. To start the regeneration process, the start button 230 is depressed causing power to be provided to the heating element. Concurrently, light 234 is illuminated. During the regeneration process, the power to the heating element can be stopped at any time by manually depressing the emergency stop button 232.

If after three minutes the temperature controller 314 is not sensing 500° F. at the heating element, the controller 306 aborts the start up process and the light 234 is flashed indicating a regeneration failure. Similarly, if at any time the temperature controller 314 senses a temperature over 1400° F. at the heating element, the controller 306 aborts the regeneration cycle and the light 234 is flashed.

Under normal operating conditions, the controller will control an initial 20 minute warm up sequence. During the warm up sequence, no compressed air is provided to the exhaust treatment device. After the 20 minute warm up, the controller 306 begins opening and closing the solenoid 308 to provide pulses of air to the exhaust treatment device. In one embodiment, the air is pulsed at a rate of 1 second on and 15 seconds off. This generates an air flow rate of at least about 3 cubic feet per minute, and preferably at least about 4 cubic feet per minute. During this sequence, the light 234 continues to be illuminated. Additionally, if during the regeneration sequence, the pressure provided by the air line 212 falls below a predetermined level, the controller 306 will abort the sequence.

After a predetermined time period (e.g., 4 hours and 20 minutes), the controller 306 stops the regeneration process and begins the cool down process. To begin the cool down process, power to the heating element is terminated. Also, the amount of air provided to the exhaust treatment device 20 can be increased. For example, air can be provided at a pulse rate of 1 second on and 6 seconds off. During cool down, the light 234 is turned off and the light 236 is turned on.

After about 7 hours from initiating the regeneration sequence, the solenoid 308 is de-energized and the cool down cycle ends. The light 237 is then flashed indicating that the entire cycle is complete.

Further information concerning regeneration cycles and recipes can be found in PCT Patent Application No. PCT/US2006/001850, filed on Jan. 18, 2006 and entitled Apparatus for Combusting Collected Diesel Exhaust Material from Aftertreatment Devices and Methods that is hereby incorporated by reference in its entirety.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A shore station for use in regenerating diesel particulate filters of exhaust treatment devices by heating the exhaust treatment devices with heaters, the shore station comprising:

a control unit having a power input;

multiple power output cords extending outwardly from the control unit for allowing the control unit to be connected to multiple heaters at the same time;

multiple combustion air lines extending outwardly from the control unit for providing combustion air to multiple exhaust treatment devices in regenerating diesel particulate filters of the exhaust treatment devices, wherein the control unit measures the pressure provided by the combustion air lines such that if the pressure falls below a predetermined level for a predetermined amount of time, the control unit aborts a regeneration event.

2. The shore station of claim 1, wherein the control unit is configured to alternate power between first and second power output cords of the multiple power output cords.

3. The shore station of claim 1, wherein power is not supplied to first and second power output cords of the multiple power output cords at the same time.

4. The shore station of claim 1, further comprising at least one temperature controller configured to receive temperature feedback from thermocouples of the exhaust treatment devices, wherein the temperature controller is configured to control the temperature of the heaters of the exhaust treatment devices.

5. The shore station of claim 1, wherein the control unit is configured to provide power to the heaters of the exhaust treatment devices without providing combustion air to the exhaust treatment devices during a warm up sequence of regeneration.

6. The shore station of claim 5, wherein the control unit is configured to provide air to the exhaust treatment devices without providing power to the heaters during a cool down sequence of regeneration.

7. The shore station of claim 6, wherein the control unit is configured to provide pulses of air at a rate of 1 second on and 6 seconds off during the cool down sequence.

8. The shore station of claim 5, wherein the control unit is configured to provide pulses of air to the exhaust treatment devices after the warm up sequence.

9. The shore station of claim 8, wherein air is pulsed at a rate of 1 second on and 15 seconds off after the warm up sequence.

10. The shore station of claim 8, wherein the control unit is configured to generate an air flow rate of at least 3 cubic feet per minute after the warm up sequence.

11. A shore station for use in regenerating diesel particulate filters of exhaust treatment devices by heating the exhaust treatment devices with heaters, the shore station comprising:

a control unit having a power input;

multiple power output cords extending outwardly from the control unit for allowing the control unit to be connected to multiple heaters at the same time;

multiple combustion air lines extending outwardly from the control unit for providing combustion air to multiple exhaust treatment devices in regenerating diesel particulate filters of the exhaust treatment devices;

wherein the control unit is configured to provide power to the heaters of the exhaust treatment devices without providing combustion air to the exhaust treatment devices during a warm up sequence of regeneration and wherein the control unit is configured to provide pulses of air to the exhaust treatment devices after the warm up sequence.

12. The shore station of claim 11, wherein air is pulsed at a rate of 1 second on and 15 seconds off after the warm up sequence.

13. The shore station of claim 11, wherein the control unit is configured to generate an air flow rate of at least 3 cubic feet per minute after the warm up sequence.

14. A shore station for use in regenerating diesel particulate filters of exhaust treatment devices by heating the exhaust treatment devices with heaters, the shore station comprising:

a control unit having a power input;

multiple power output cords extending outwardly from the control unit for allowing the control unit to be connected to multiple heaters at the same time;

multiple combustion air lines extending outwardly from the control unit for providing combustion air to multiple exhaust treatment devices in regenerating diesel particulate filters of the exhaust treatment devices;

wherein the control unit is configured to provide power to the heaters of the exhaust treatment devices without providing combustion air to the exhaust treatment devices during a warm up sequence of regeneration, wherein the control unit is configured to provide air to the exhaust treatment devices without providing power to the heaters during a cool down sequence of regeneration, and wherein the control unit is configured to provide pulses of air at a rate of 1 second on and 6 seconds off during the cool down sequence.

15. The shore station of claim 11, wherein the control unit is configured to alternate power between first and second power output cords of the multiple power output cords.

16. The shore station of claim 11, wherein power is not supplied to first and second power output cords of the multiple power output cords at the same time.

17. The shore station of claim 11, further comprising at least one temperature controller configured to receive temperature feedback from thermocouples of the exhaust treatment devices, wherein the temperature controller is configured to control the temperature of the heaters of the exhaust treatment devices.

18. The shore station of claim 11, wherein the control unit is configured to provide air to the exhaust treatment devices without providing power to the heaters during a cool down sequence of regeneration.

19. The shore station of claim 18, wherein the control unit is configured to provide pulses of air at a rate of 1 second on and 6 seconds off during the cool down sequence.

20. A shore station for use in regenerating diesel particulate filters of exhaust treatment devices of at least two different vehicles by heating the exhaust treatment devices with heaters of the at least two different vehicles, the shore station comprising:

a control unit having a power input;

at least two power output cords extending outwardly from the control unit for allowing the control unit to be connected to the heaters of the at least two different vehicles at the same time and at least two combustion air lines in addition to the at least two power output cords extending outwardly from the control unit for allowing combustion air to be provided to the exhaust treatment devices of the at least two different vehicles for regenerating the diesel particulate filters of the at least two different vehicles at the same time;

wherein the control unit is configured to coordinate regeneration of the diesel particulate filters of the exhaust treatment devices of the at least two different vehicles to allow at least a part of a regeneration event of a first vehicle of the at least two vehicles to overlap with at least a part of a regeneration event of a second vehicle of the at least two vehicles to reduce the overall time required to regenerate the diesel particulate filters of the exhaust treatment devices of the at least two different vehicles independently.

21. The shore station of claim 20, wherein the control unit is configured to control the temperatures of the heaters of the at least two different vehicles at the same time by modulating the power back and forth between the heaters of the at least two different vehicles without requiring power to be provided to the heaters of both of the at least two different vehicles at the same time.

22. The shore station of claim 20, further comprising at least one temperature controller configured to receive temperature feedback from thermocouples of the exhaust treatment devices, wherein the temperature controller is configured to control the temperature of the heaters of the exhaust treatment devices.

23. The shore station of claim 20, wherein the control unit is configured to provide power to the heaters of the exhaust treatment devices without providing combustion air to the exhaust treatment devices during a warm up sequence of regeneration.

24. The shore station of claim 23, wherein the control unit is configured to provide pulses of air to the exhaust treatment devices after the warm up sequence.

25. The shore station of claim 23, wherein the control unit is configured to provide air to the exhaust treatment devices without providing power to the heaters during a cool down sequence of regeneration.

* * * * *